US006943691B2

(12) United States Patent
Chambers

(10) Patent No.: US 6,943,691 B2
(45) Date of Patent: Sep. 13, 2005

(54) TAMPER INDICATOR FOR A SMOKE DETECTOR

(76) Inventor: Bill Chambers, c/o 866 Main Street East, Hamilton, Ontario (CA), L8M 1L9

( * ) Notice: Subject to any disclaimer, the term of this patent is extended or adjusted under 35 U.S.C. 154(b) by 556 days.

(21) Appl. No.: 10/046,093

(22) Filed: Jan. 16, 2002

(65) Prior Publication Data

US 2002/0097162 A1 Jul. 25, 2002

Related U.S. Application Data

(60) Provisional application No. 60/262,394, filed on Jan. 19, 2001.

(51) Int. Cl.[7] ..... G08B 17/10

(52) U.S. Cl. ..... 340/628; 340/693.11; 340/693.5

(58) Field of Search ..... 340/521, 628, 340/693.11, 693.5, 693.7, 693.9, 568.1, 571, 577, 568.4; 200/61.03

(56) References Cited

U.S. PATENT DOCUMENTS 4,092,641 A 5/1978 Bellinghausen et al. .... 340/409
4,117,467 A * 9/1978 Liou Tchen San ..... 340/506
4,258,291 A * 3/1981 Scott et al. ..... 315/156
4,267,549 A * 5/1981 Taylor ..... 340/302
4,319,234 A * 3/1982 Rice ..... 340/628
4,959,640 A 9/1990 Hall ..... 340/693
5,077,001 A * 12/1991 Makowka ..... 383/5
5,103,216 A 4/1992 Sisselman ..... 340/693
5,149,038 A * 9/1992 VanCleve ..... 248/297.21
5,574,436 A 11/1996 Sisselman ..... 340/663
5,646,598 A 7/1997 Nicles et al. ..... 340/628
5,820,406 A 10/1998 Hetherington ..... 439/500
6,753,788 B1 * 6/2004 Munyon ..... 340/815.4

* cited by examiner

*Primary Examiner*—Anh V. La

(57) ABSTRACT

The present invention is a tamper indicating kit for use with a smoke detector having a base plate for mounting to a mounting surface such as a ceiling or wall, and the smoke detector also including an openable cover connected to the base plate; the tamper indicating kit includes: a thing planar adapter flange including a horizontal top section adapted to be sandwiched between a base plate and a mounting surface, a side section extending vertically downwardly from a distal end of the top section; a horizontal relief section extending horizontally inwardly from a distal end of the side section, and a flexible leg extending angularly downwardly from a distal end of the horizontal relief section, the flexible leg adapted to flex from an unmounted position to a mounted position adjacent to a cover outer wall; and adhesive tape producing an irreversible indication upon opening or tampering with a cover taping together at least a portion of the side element to a cover.

13 Claims, 6 Drawing Sheets

FIGURE - 1
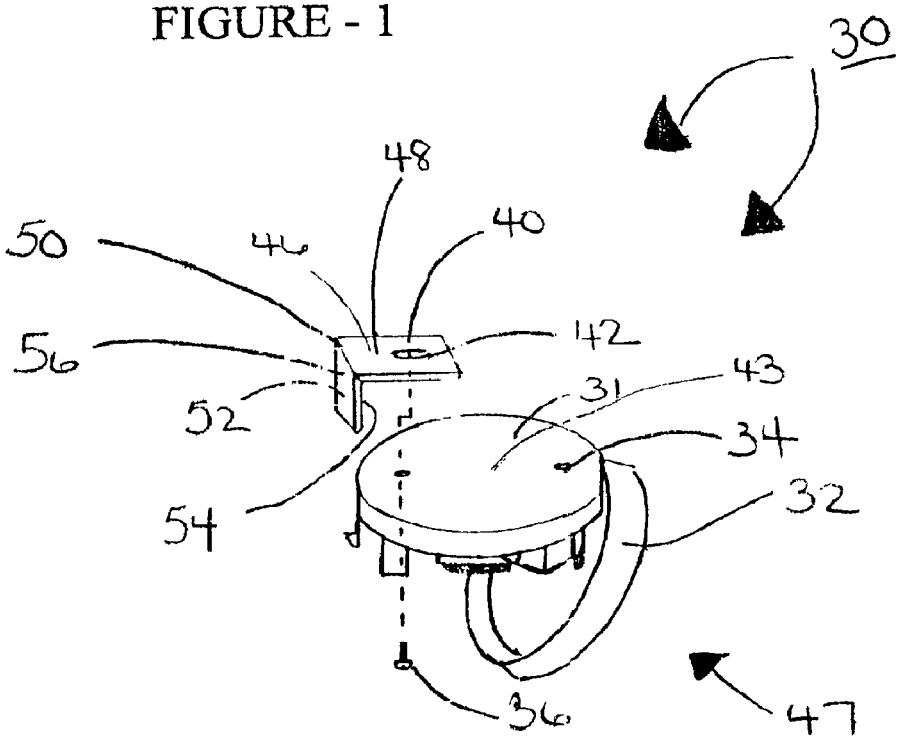
FIGURE - 2
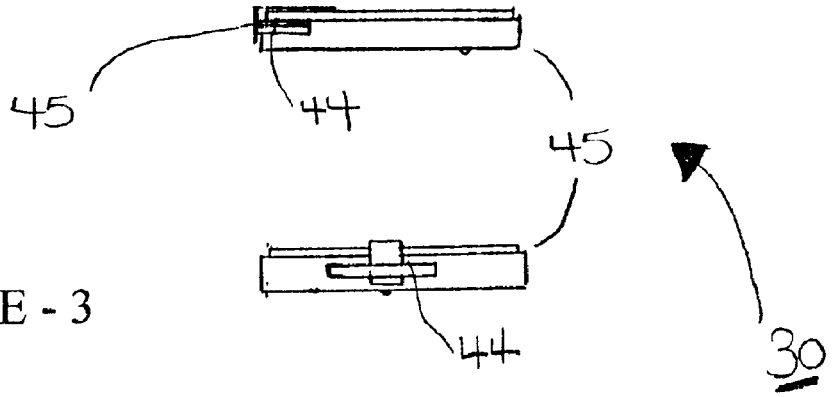
FIGURE - 3

FIGURE - 13
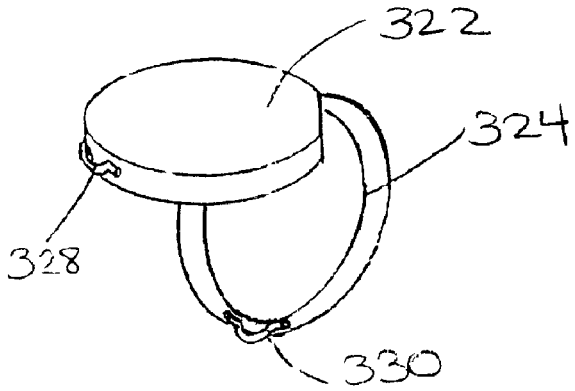
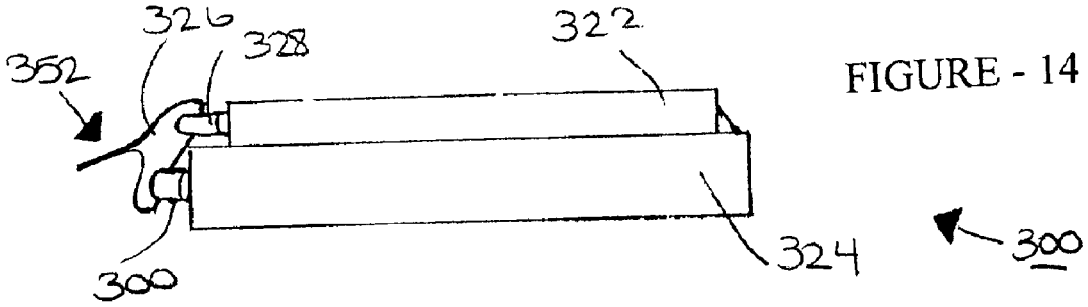
FIGURE - 14
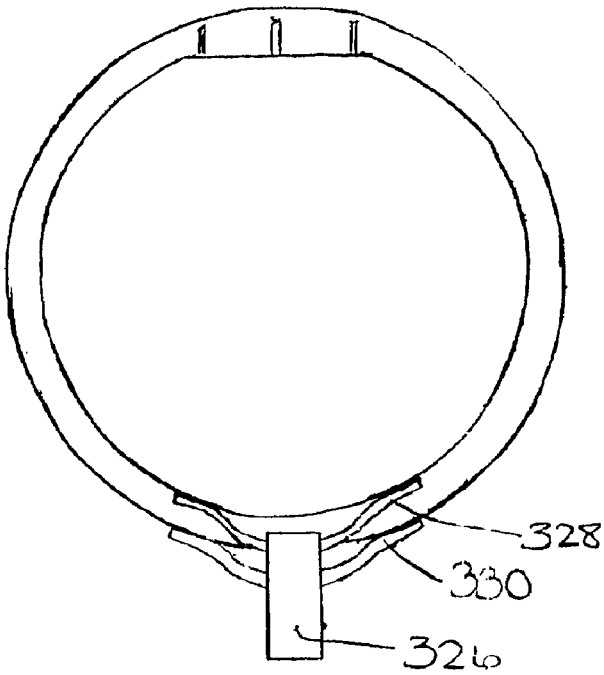
FIGURE - 15

TAMPER INDICATOR FOR A SMOKE DETECTOR

This application claims the benefit of Provisional Application No. 60/262,394, filed Jan. 19, 2001.

FIELD OF THE INVENTION

The present invention relates to detecting tampering of smoke detectors and in particular relates to detecting unauthorized opening of hinged type smoke detectors.

BACKGROUND OF THE INVENTION

Statistics indicate that three quarters of American homes have at least one smoke detector. However, the National Fire Protection Agency estimates that ⅓ of those detectors do not work, often because of dead or missing batteries. The industry is aware of the problems associated with smoke detectors and has responded with several safety features that are effective, but no flawless as evidence in the above statistics. Modern smoke detectors warn a person when a smoke detectors battery is low by producing a chirping sound, one a minute. This chirp continues for approximately a month when the battery goes dead or until someone either replaces or removes the battery. Often users will remove the battery in order to silence the disruptive chirping rather than replace it with a new battery.

Dead batteries probably reflect the lack of regular testing and maintenance and the problem may be compounded by some individuals unfamiliarity with the meaning of the sounds and signals now used to indicate low battery power.

A prevalent smoke detector on the market today includes a hinged cover that is attached to the detectors base plate in which the base plate houses the battery and the electrical components. The hinge cover is designed to that it cannot be closed unless the battery is present. However, the hinged cover can easily be forced into position when no battery is present. Furthermore, when the hinge cover is not in the closed position, there is no visual warning indicating a missing battery, just exposed electronic circuitry. Again a person may assume that the detector to falter and remove it completely.

Another smoke detector designed includes a battery drawer that slides in and out from the smoke detector on a horizontal motion. The compartment door cannot be repositioned into the smoke detector unless the battery is present. The door however is slightly bigger than the battery and therefore offers no effective visual warning that the battery is missing.

Furthermore, if the smoke detectors battery has been repositioned so that the batteries terminals are reversed or are not in contact with the battery, the hinged covered battery compartment may still be able to be closed, since the battery is actually present. In the case of the external battery compartment, the detector can still be mounted since the battery is in the compartment.

Furthermore, landlords are responsible for defective and/or non-operative smoke detectors which are located inside residential apartment units. There is no way for a landlord to assure or prove that he has placed a fresh battery inside the smoke detector and/or be able to conclusively give evidence that the tenant has not removed and/or otherwise tampered with the detector.

Therefore, there is a need for a tamper indicator for smoke detectors which would allow a landlord of apartment buildings and/or official of the Fire Department to be able to determine that in fact a battery has been installed on a certain date and has not been tampered with since.

SUMMARY OF THE INVENTION

The present invention a tamper indicating kit for use with a smoke detector having a base plate for mounting to a mounting surface such as a ceiling or wall, and said smoke detector also including an openable cover pivotally connected to said base plate; the tamper indicating kit including:

(a) a thin planar adapter flange including a top element adapted to be fastened to a base plate, and (b) said adapter flange further including a side element adapted to extend proximate a cover;

(c) a means for securing at least a portion of said side element to a cover such that opening a cover produces an irreversible indication of opening or tampering.

Preferably wherein said top element and said side element are pivotally connected.

Preferably wherein said top element includes an aperture defined therein for passage there through of a fastener.

The invention a tamper indicating kit for use with a smoke detector having a base plate for mounting to a mounting surface such as a ceiling or wall, and said smoke detector also including an openable cover pivotally connected to said base plate; the tamper indicating kit also including:

(a) a thing planar adapter flange including a horizontal top section adapted to be fastened to a base plate, a side section extending vertically downwardly from a distal end of said top section; a horizontal relief section extending horizontally inwardly from a distal end of said side section, and a vertical section extending vertically downwardly from a distal end of said horizontal relief section, said vertical section adapted to extend parallel and adjacent to a portion of a cover;

(b) a means for securing at least a portion of said side element to a cover such that opening a cover produces an irreversible indication of opening or tampering.

The present invention a tamper indicating assembly comprising in combination a tamper indicator and a smoke detector, said tamper indicating assembly comprising:

(a) a smoke detector including a base plate for mounting to a mounting surface such as a ceiling or wall and said smoke detector also including an openable cover pivotally connected to said base plate; parallel and adjacent to a portion of;

(b) an adapter flange rigidly connected to said base plate and extending said cover; and (c) a means for securing at least a portion of said adapter flange to said cover such that opening said cover produces an irreversible indication of opening or tampering.

Preferably wherein said adapter flange includes a top element for connecting to said base plate and a side element extending parallel and adjacent to a portion of said cover, wherein said top element and said side element are pivotally connected.

Preferably wherein said top element includes an aperture for passage there through of a fastener.

Preferably wherein said top element of said adapter flange being thinly dimensioned for sandwiching between the base plate and mounting surface, such that said base plate remains substantially flush with said mounting surface.

Preferably wherein said side element pivoted and dimensioned to extend substantially parallel and adjacent to a cover vertical wall of said cover.

BRIEF DESCRIPTION OF THE DRAWINGS

FIG. 1 is a schematic exploded assembly view of an adapter flange together with a conventional smoke detector.

FIG. 2 is a schematic side elevational view of adapter flange mounted onto a smoke detector.

FIG. 3 is a schematic front elevational view of a smoke detector together with an adapter flange.

FIG. 13 is a schematic perspective view of a smoke detector together with the base plate and a cover showing cover and base plate flanges.

FIG. 14 is a side elevational schematic view of a smoke detector together with the tape shown in the tape sealed position.

FIG. 15 is a top elevational view of a smoke detector together with the tape shown in the tape sealed position.

DETAILED DESCRIPTION OF THE PREFERRED EMBODIMENT

Definition

Figure 4:
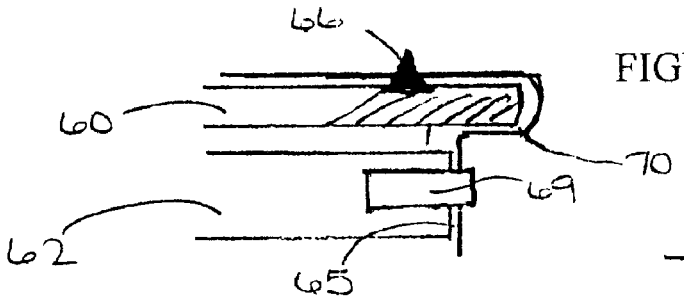
FIG. 4 is a schematic partial cut away view of a smoke detector together with an adapter flange shown mounted thereon.

In this patent smoke detector and/or smoked alarm and/or smoke alarm detector all refer to a battery operated detection device for smoke, or carbon monoxide which are normally used in residential homes and apartments.

The present invention shown generally as a tamper indicator adapter kit 30 shown in FIGS. 1, 2 and 3 shows a tamper indicator adapter kit which consists of a adapter flange 40 and tamper evidence tape 44 which is shown deployed together with a conventional smoke detector 47 having a base plate 31, hinge cover 32, fastening apertures 34 and screw fasteners 36 for holding said base plate 31 to a ceiling or wall.

The tamper indicator adapter kit shown generally as 30 includes adapter flange 40 having an aperture 42, a top element 46 having a top surface 48, a hinged portion 50 connected to a side element 56 having an outer surface 52 and an inner surface 54. Tape 44 is also part of adapter kit 30.

In use the present embodiment of the invention, a tamper indicator adapter kit shown generally as 30, is installed onto a smoke detector having a base plate 31 and a cover 32 as follows. Top element 46 of adapter flange 40 is placed on the rear side 43 of face plate 31 as shown. One of fastening apertures 34 which are used to fasten base plate 31 onto a wall or ceiling, is aligned with aperture 42 in top element 46. Screw fastener 36 passes through fastening aperture 34 as well as aperture 42 of adapter flange 40 and into the ceiling or wall thereby fastening base plate 31 together with adapter flange 40 to the wall or ceiling. In this manner top element 46 is sandwiched between base plate 31 and the wall or ceiling. Subsequently side element 56 which has an outer surface 52 and an inner surface 54 and a hinge point 50 is hinged to align vertically with the cover vertical wall 45 of cover 32 such that side element 56 lies parallel and adjacent to cover vertical wall 45 surface of cover 32. Note that "cover vertical wall" is also referred to as "cover outer wall" in this patent and may or may not be vertical.

Hinge 50 is of the type known in the plastic art including scoring or variation in thickness along the hinge line.

Subsequently, tape 44 which for example can be a 3M type tape which is marketed under number 7930 is applied across the outer surface 52 of side element 56 and also onto cover vertical wall 45 thereby adhesively fastening adapter flange 40 to cover 32. Once tape 44 is in place, should someone attempt to open cover 32, tape 44 shatters or self destructs, thereby indicating that the smoke detector unit has been tampered with.

3M type tape number 7930 is a destructible vinyl label material. Once this material has been applied to a surface, should any attempts be made to remove it in any manner, it destructs itself by shattering and/or tearing and thereby indicating that the tape has been tampered with and/or attempts have been made to remove the tape and/or move the tape. 3M claims that tape 7930 is made of a low shrinkage vinyl which produces a dimensionally stable label without adhesive ooze or dirty edges. It comes with an aggressive acrylic adhesive which provides high bond and excellent destructibility on most surfaces including metals, plastics, power coated surfaces and other including many low energy surface materials. 3M provides many other data in regard to this material 7930 which the inventor has found to be useful for this application.

Figure 5:
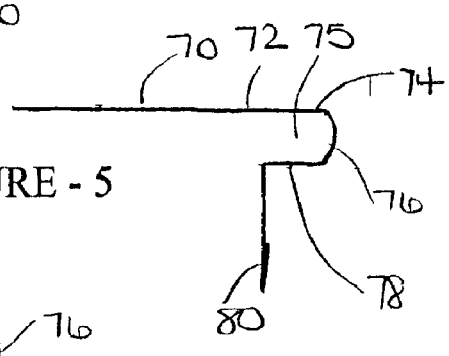
FIG. 5 is a cross sectional view of the adapter flange.

Referring now to FIGS. 4, 5, 6, 7 and 8, a presently preferred embodiment shown generally as tamper indicator adapter kit 100 is useful when the smoke detector has geometries other than those shown in FIGS. 1, 2 and 3. For example, in FIG. 4, base plate 60 has a larger diameter than cover 62 thereby adapter flange 70 must be modified to fit over face plate 60 and onto cover 62. FIG. 5 shows a proposed geometry for adapter flange 70 having a top section 72, top surface 74, side section 76, horizontal relief section 78 and a vertical section 80. One can see that adapter flange 70 in this case has a relief portion shown generally as 75 which allows for the greater diameter of base plate 60 than cover 62. By providing relief portion 75, one can bring vertical section 80 into close proximity with cover vertical wall 85 thereby assuring that vertical section 80 lies substantially parallel and adjacent to cover vertical wall 85 as shown in FIG. 4. This will then allow the user to apply tape 69 which is again preferably the 3M type 7930 onto cover 62 of smoke detector. Adapter flange 70 is mounted identically to adapter flange 40 described in the previous embodiment and shown in FIGS. 1, 2 and 3.

Figure 6:
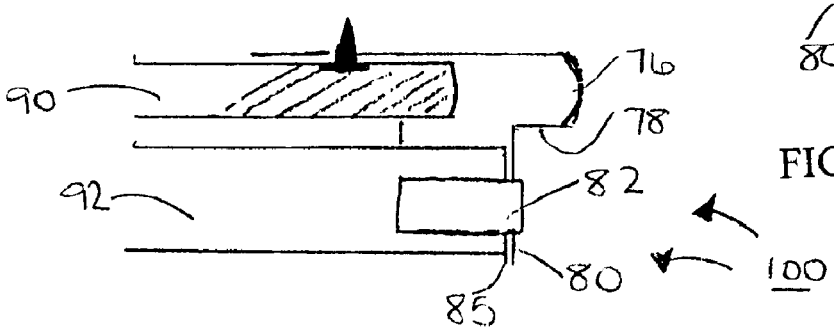
FIG. 6 is a partial cross-sectional cut away view of the adapter flange mounted onto a smoke detector.

FIG. 6 shows a smoke detector having geometry in which the base plate 90 is a smaller diameter than cover 92. In this case, adapter flange 70 can also be used even though the relief portion 75 is not required in order for vertical section 80 to be aligned parallel and adjacent to cover vertical wall 85. The reader will note that adapter flange 70 can used for smoke detectors having geometry shown in FIGS. 1, 2 and 3, FIG. 4 and/or in FIG. 6.

Figure 7:
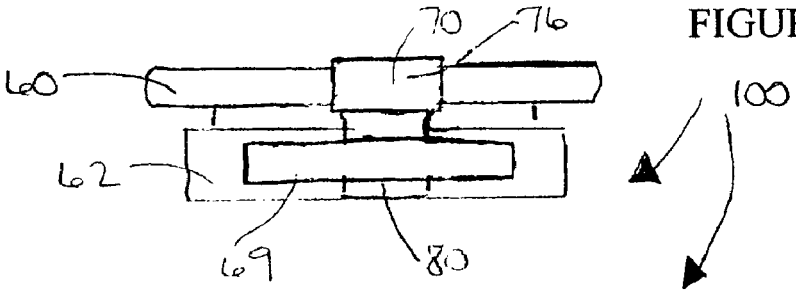
FIG. 7 is a front elevational view of an adapter flange shown in situ and mounted onto a smoke detector with a tape.
Figure 8:
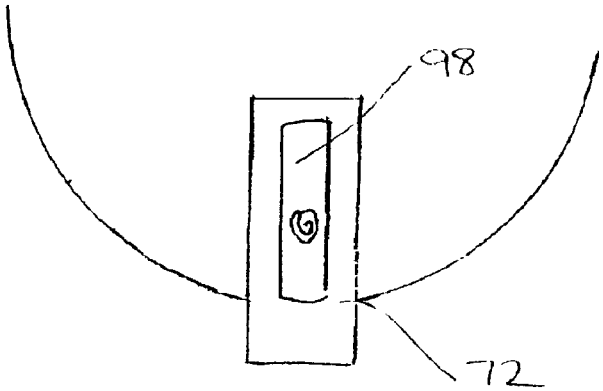
FIG. 8 is a top partial cut away view of the adapter flange shown mounted onto the top surface of a smoke detector base plate.

FIGS. 7 and 8 show the tamper indicator adapter kit installed onto a smoke detector having geometry as shown in FIG. 4 wherein the base plate 60 has a larger diameter than the cover 62. In FIG. 7 for example, the adapter flange 70 is shown in place with tape 69 adhering to vertical section 80 as well as cover vertical wall 85. Thereby as soon as someone attempts to remove or open cover 62, tape 69 will shatter thereby indicating that the unit has been tampered with.

FIG. 8 shows a top schematic view of the top section 72 of adapter flange 70 and slot 98 defined therein for passage there through of screw fastener 66. By having slot 98 in top section 72 of adapter flange 70, one is able to accommodate the different geometries as shown in FIGS. 4 and 6 of various smoke detectors. In addition, by having slot 98, the positioning of screw fastener 66 (being different for every manufacture of smoke detector) is so constructed that adapter flange 70 can be utilized with many types of smoke detectors on the market.

Figure 9:
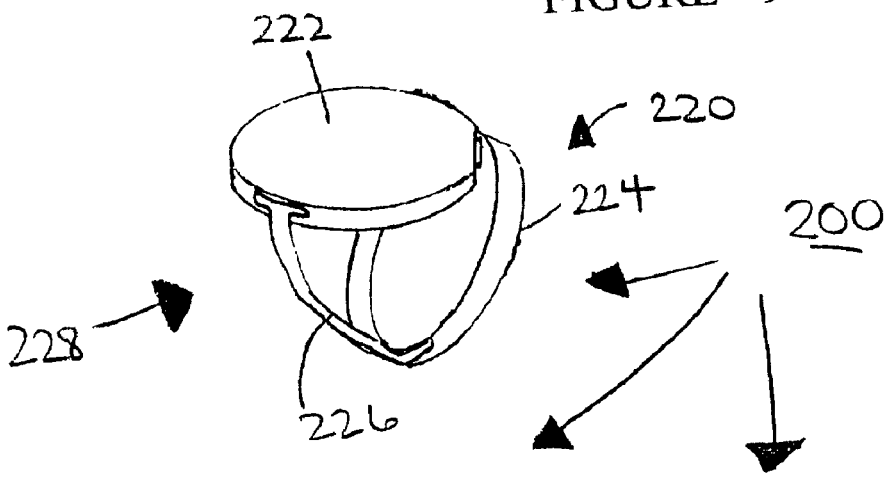
FIG. 9 is a schematic perspective view of a smoke detector with a tape shown attached to the base plate as well as the cover.

Referring now to FIGS. 9, 10, 11 and 12 an alternate embodiment to the present invention, a tamper indicator method showing generally as 200 includes a smoke detector 220 having a base plate 222 and a hinge cover 224 which is shown in the open position 228 in FIG. 9. Preferably tape 226 is an equivalent to 3M tape number 7937 or 7384 which is a tamper indicating sheet label material having a high strength acrylic adhesive providing a high bond onto most surfaces and has a poly coated face stock to with stand harsh environments.

Figure 10:
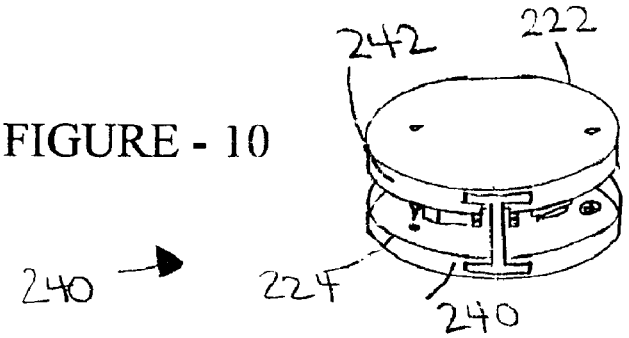
FIG. 10 is a schematic perspective view of a smoke detector showing the tape attached to the base plate as well as the cover.
Figure 11:
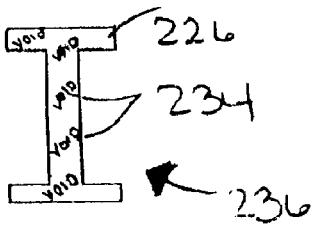
FIG. 11 is a schematic front elevational view of the tape shown in the tape as tampered condition, showing the tampered indication, mainly the word void.
Figure 12:
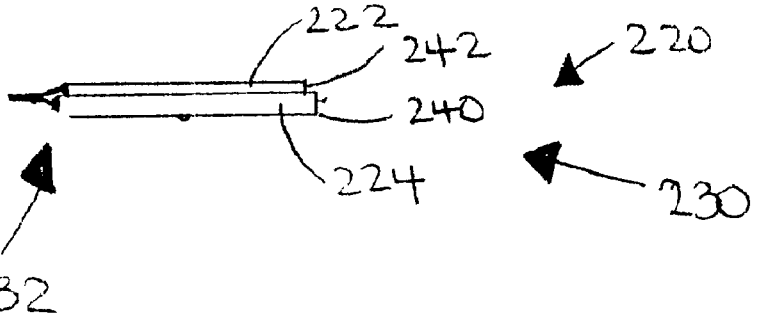
FIG. 12 shows a smoke detector together with the tape in the sealed position prior to any tampering.

Referring now to FIG. 11, tape 226 is preferably cut out in a capital I shape as shown in FIG. 11 and the top and bottom portions of the I are applied as shown in FIG. 10 to the base plate vertical wall 242 and the other end to the cover vertical wall 240. Cover 224 has been hinged closed to mate with base plate 224 as shown in the closed position 230 of FIG. 12. Tape 226 is then firmly pressed and sealed together into the tape seal position 232 as shown in FIG. 12. Any attempt to open or hingeably move cover 224 away from base plate 22 results in tape 226 becoming unsealed from the tape sealed position 232. Should cover 224 be hinged open from base plate 222, tape 226 would look as shown in FIG. 9. Once tape 226 is forcibly unsealed after it has been in the tape sealed position 232, "void" tamper indications 234 appear on the tape indicating that the tape has been sealed and subsequently unsealed.

FIG. 11 shows tape 226 in the as tampered condition 236 showing tamper indications 234 which in this case are the words "void" which visibly can be seen along the tape where it has been unsealed.

Referring now to FIGS. 13, 14 and 15, another alternate tamper indicator method shown generally as 300 which is similar to the tamper indicator method shown generally as 200, however in this case base plate 322 is equipped with a base plate flange 328 and cover 324 is equipped with a cover flange 330. Base plate flange 328 and cover flange 330 can be intregally moulded and part of base plate 322 and cover 324 respectively or can be subsequently attached via screws or other fastening methods.

Tape 326 which is the same or similar as tape 226 is preferably 3M type tape known as number 7937 in white or 7384 in silver which is a tamper indicating sheet label material which is positioned as shown in FIG. 14, in the tape sealed position 352. Similar to tamper indicator method 200, should any attempts be made to move or hingeably urge cover 324 away from base plate 322, tape 326 become unsealed and therefore tamper indications similar to those shown in FIG. 11 would appear on tape 326 indicating that the tape has been tampered with. This will also indicate that someone has attempted to open the cover and/or has opened the cover and moved it away from the base plate. By using either the tamper indicator method 300 or the tamper indicator method 200, one can equally apply a tape 326 or 226 to an existing smoke detector in the case of tamper indicator method 200 or to a modified smoke detector as in the case of tamper indicator method 300 which will allow the installer of a battery to seal off a smoke detector thereby ensuring any tampering attempts to open the smoke detector can be positively identified.

DESCRIPTION OF PRESENTLY PREFERRED EMBODIMENT

Figure 16:
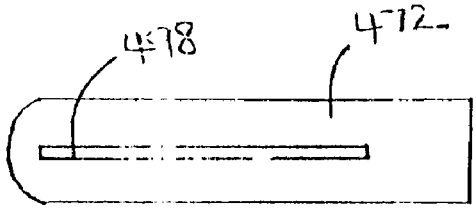
FIG. 16 is a top schematic view of a presently preferred embodiment of the adapter flange.
Figure 17:
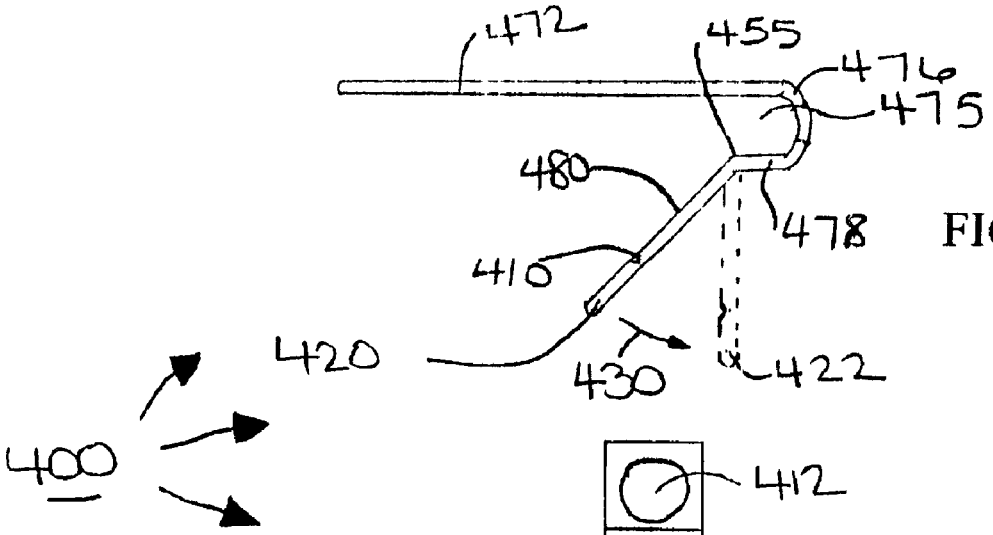
FIG. 17 is a schematic side elevational view of the adapter flange.
Figure 18:
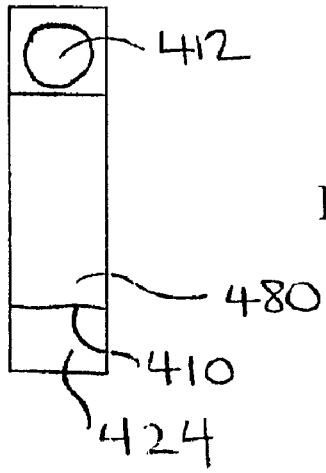
FIG. 18 is a schematic front elevational view of the adapter flange.

Referring now to an alternate presently preferred embodiment shown in FIGS. 16 to 21 inclusively, the presently preferred embodiment of the invention namely, tamper indicator adaptor kit 402 is comprised of an adaptor flange shown generally as 400 depicted in FIGS. 16 through 18.

The tamper indicator adapter kit 402 functions in an analogous manner as does the tamper indicator adapter kit 100 which is depicted in FIGS. 4, 5, 6, 7 and 8. The major difference between the tamper indicator adapter kit 100 and the tamper indicator adapter kit 402 depicted in FIGS. 16 through 21 is the Geometrical difference between the adapter flange 400 and the adapter flange 70 of the previous embodiment. In particular adapter flange 400 has a flexible leg 480 rather than vertical section 80 of the previous embodiment. Flexible leg 480, however hinges about hinge point 455 in a biasing fashion from unmounted position 420 to a mounted position 422 as shown particularly in FIG. 17.

Adapter flange 400 is comprised of the following major components, namely top section 472, slot 498, side section 476, horizontal relief section 478, and flexible leg 480 which is moveable between unmounted position 420 and mounted position 422. In addition adapter flange 400 also optionally can include an aperture 412, notch 410 and a break away portion 424 of flexible leg 480.

Flexible leg 480 normally lies in the unmounted position 420 as shown in FIG. 17 and can be urged from the unmounted position 420 by applying pressure to flexible leg 480 in the deflection direction 430, until flexible leg 480 is urged into the mounted position 422 which is very close to a vertical position. Flexible leg 480, more or less flexes about hinge point 455, however there may be some deflection of horizontal relief section 478 as shown in FIG. 21 as deflection of horizontal relief section 479.

Figure 19:
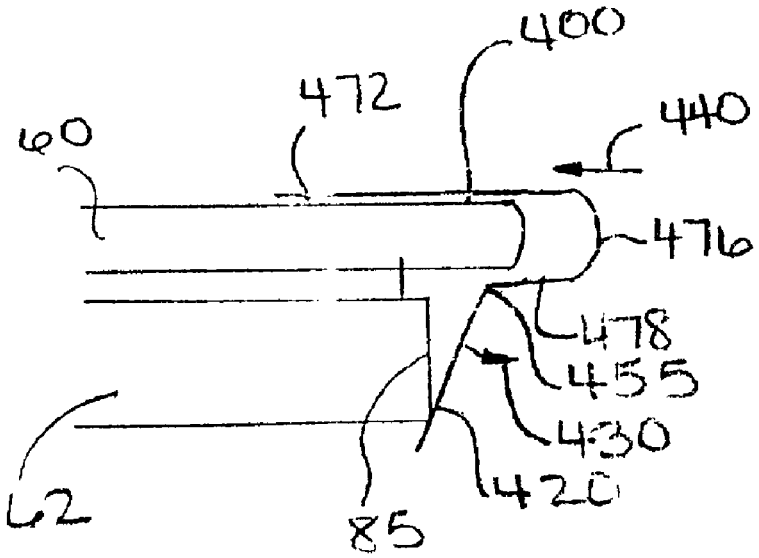
FIG. 19 is a schematic representation of the deployment of the adapter flange onto a smoke detector having a base plate and a cover in the initial installation position.
Figure 20:
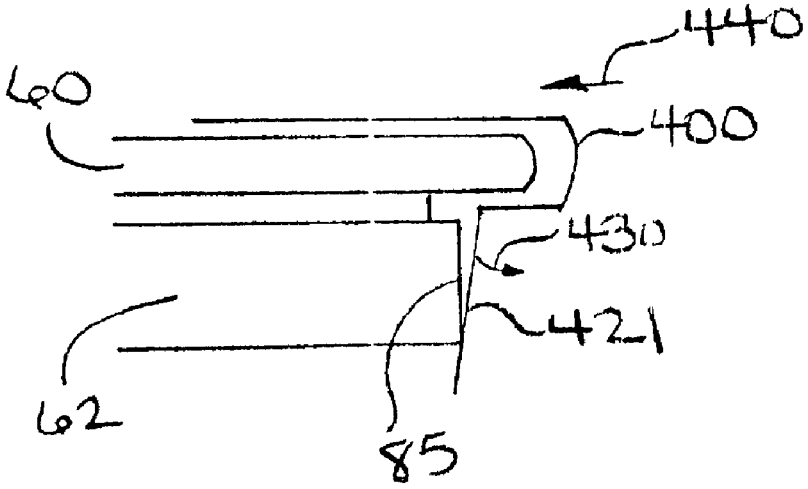
FIG. 20 is a schematic illustration of deployment of the adapter flange onto a smoke detector in the partially mounted position.
Figure 21:
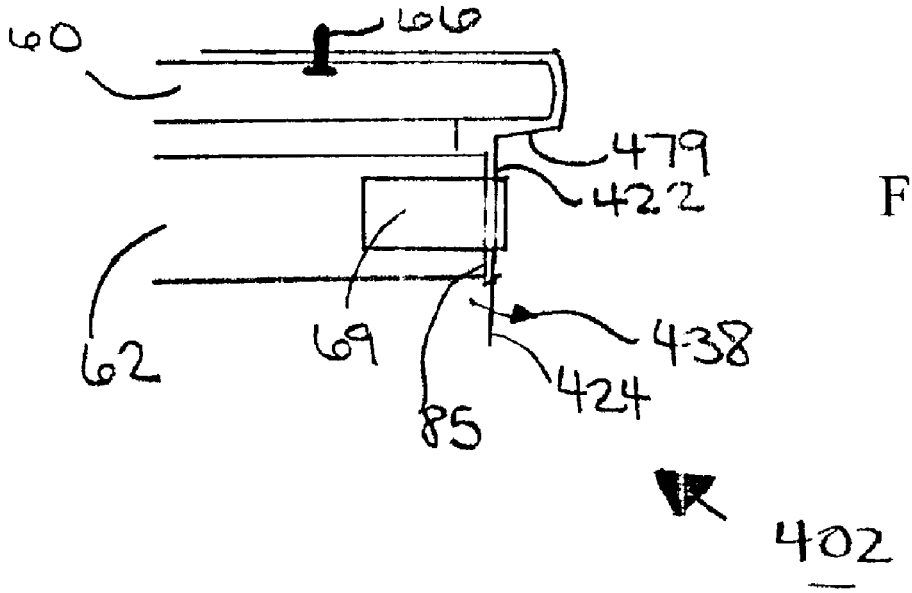
FIG. 21 is a schematic representation of the adapter flange diploid onto a smoke detector together with a tape all combined together providing a tamper indicator adapter kit.

In use as best shown in FIGS. 19, 20 and 21 which depicts the sequence of mounting adapter flange 400 onto a smoke detector base plate 60 and cover 62. Adapter flange 400 -is urged in the installation direction 440 as shown by the arrow in FIG. 19. Flexible leg 480 makes contact with cover vertical wall 85 of cover 62 deflecting flexible leg 480 as adapter flange 400 is urged along the installation direction 440. As flexible leg 480 is deflected into the deflection direction 430 it imparts a biasing force onto cover vertical wall 85.

FIG. 20 showing adapter flange 400 in a partially mounted condition as the user continues to urge adapter flange 400 in the installation direction 440, flexible leg 480 is deflected more and more to the vertical position and imparts a greater amount of biasing force against cover vertical wall 85.

In FIG. 21, adapter flange 400 is shown in the installed position with a screw fastener 66 holding adapter flange 400 in place and flexible leg 480 aligned parallel and adjacent to cover vertical wall 85 and tape 69 placed over a portion of cover 62 and the flexible leg 480 of adapter flange 400. In the installed position, there may be some deflection of horizontal section 478 as shown by a deflection of horizontal relief section 479 in FIG. 21. Should the length of flexible leg 480 be such that a large portion of it extends beyond cover 62, then a portion of flexible leg 480 can be broken away, namely break away portion 424 can be broken off at notch 410 of flexible leg 480 therefore shortening off flexible leg 480. Although not shown in the drawings, it is possible that there may be one or more notches providing for a varying size of a break away portion 424 of flexible leg 480.

A person skilled in the art will realize that in this particular embodiment, pressure or biasing force will be imparted upon cover vertical wall 85 by flexible leg 480 when adapter flange 400 is in the installed position. In this manner, one will ensure that there are no forces on tape 69 attempting to tear it away from cover 62. In addition, flexible leg 480 can also accommodate an angular cover vertical wall 85 and remain flat and adjacent to it and also ensure that there is continuos biasing against cover vertical wall 85.

It should be apparent to persons skilled in the arts that various modifications and adaptation of this structure described above are possible without departure from the spirit of the invention the scope of which defined in the appended claim.

I claim:

1. A tamper indicating kit for use with a smoke detector having a base plate for mounting to a wall or ceiling surface and said smoke detector also including an openable cover connected to said base plate; the tamper indicating kit including:

(a) a thin planar adapter flange including a horizontal top section adapted to be sandwiched between the base plate and the mounting surface, a side section extending vertically downwardly from a distal end of said top section; a horizontal relief section extending horizontally inwardly from a distal end of said side section, and a vertical section extending vertically downwardly from a distal end of said horizontal relief section, said vertical section adapted to extend parallel and adjacent to a portion of a cover outer wall;

(b) a means for securing at least a portion of said side section to the cover such that opening the cover produces an irreversible indication of opening or tampering.

2. The tamper indicating kit claimed in claim 1 wherein said securing means includes adhesive tape producing an irreversible indication upon opening or tampering with the cover.

3. The tamper indicating kit for use with a smoke detector having a base plate for mounting to a wall or ceiling surface, and said smoke detector also including an openable cover connected to said base plate; the tamper indicating kit including:

(a) a thin planar adapter flange including a horizontal top section adapted to be sandwiched between the base plate and the mounting surface, a side section extending vertically downwardly from a distal end of said top section; a horizontal relief section extending horizontally inwardly from a distal end of said side section, and a flexible leg extending angularly downwardly from a distal end of said horizontal relief section, said flexible leg adapted to flex from an unmounted position to a mounted position adjacent to a cover outer wall; and (b) a means for securing at least a portion of said side section to the cover such that opening the cover produces an irreversible indication of opening or tampering.

4. The tamper indicating kit claimed in claim 3, wherein said top section includes an aperture for passage there through of a fastener for fastening said adapter flange to said smoke detector.

5. The tamper indicating kit claimed in claim 3, wherein said top section of said adapter flange being thinly dimensioned for sandwiching between the base plate and mounting surface, such that said base plate remains substantially flush with said mounting surface.

6. The tamper indicating kit claimed in claim 3, wherein said flexible leg imparts a biassing force against the cover outer wall as it is moved from the unmounted to mounted position to ensure that said flexible leg remains adjacent to a cover outer wall surface.

7. The tamper indicating kit claimed in claim 3 wherein said flexible leg includes at least one break away portion defined by a notch for removing a distal portion of said flexible leg projecting downwardly beyond the cover.

8. The tamper indicating kit claimed in claim 3 wherein said adapter flange further includes ventilation apertures defined by said flange and which may be randomly located.

9. The tamper indicating kit claimed in claim 3 wherein said flexible leg disposed at substantially a 45 degree angle downwardly relative to vertical in the unmounted position.

10. The tamper indicating kit claimed in claim 3 wherein said flexible leg made of a springy or resilient material to permit flexion of said flexible leg from unmounted to mounted position.

11. The tamper indicating kit claimed in claim 3, wherein a portion of said top section, side section and horizontal relief section form a relief portion for accommodating various shaped base plates.

12. The tamper indicating kit claimed in claim 3, wherein said top section includes an slot for passage there through of a fastener and for providing for adjustability of said adapter flange relative to said smoke detector when in said mounted position.

13. The tamper indicating kit claimed in claim 3, wherein said securing means includes adhesive tape producing an irreversible indication upon opening or tampering with the cover.

* * * * *